US005138324A

United States Patent [19]

Aubry et al.

[11] Patent Number: 5,138,324

[45] Date of Patent: Aug. 11, 1992

[54] DEVICE TO MEASURE THE ELEVATION ANGLE FOR A RADAR EQUIPPED WITH A DOUBLE CURVATURE RELECTIVE TYPE ANTENNA

[75] Inventors: Claude Aubry, Grigny; Daniel Casseau, Antony; Joseph Roger, Bures S/Yvette, all of France

[73] Assignee: Thomson-CSF, Puteaux, France

[21] Appl. No.: 731,468

[22] Filed: Jul. 17, 1991

[30] Foreign Application Priority Data

Jul. 20, 1990 [FR] France ..... 90 09305

[51] Int. Cl.[5] ..... H01Q 3/24

[52] U.S. Cl. ..... 342/140; 343/779

[58] Field of Search ..... 342/140, 147, 148; 343/755, 779

[56] References Cited

U.S. PATENT DOCUMENTS 3,234,559 2/1966 Bartholomä et al. ..... 343/155
3,495,249 2/1970 Downie ..... 343/755
4,156,243 5/1979 Yorinks et al. .
4,353,073 10/1982 Brunner et al. ..... 343/779
4,628,321 12/1986 Martin ..... 343/779 X

FOREIGN PATENT DOCUMENTS 1501344 11/1967 France .
2085873 12/1971 France .

OTHER PUBLICATIONS

Introduction to Radar Systems, 2nd edition. Skolnik, Merrill I. McGraw-Hill Book Company, 1980 pp. 258-261.

*Primary Examiner*—Mark Hellner
*Attorney, Agent, or Firm*—Oblon, Spivak, McClelland, Maier & Neustadt

[57] ABSTRACT

In a reflective angle of a radar, auxiliary elementary sources are positioned beneath the main source. By the division of the measurement signals of the measurement channel of the main source and of the auxiliary measurement channel, a monotonous characteristic is obtained, enabling the elevation angle to be measured with high precision. FIG. 1.

4 Claims, 2 Drawing Sheets

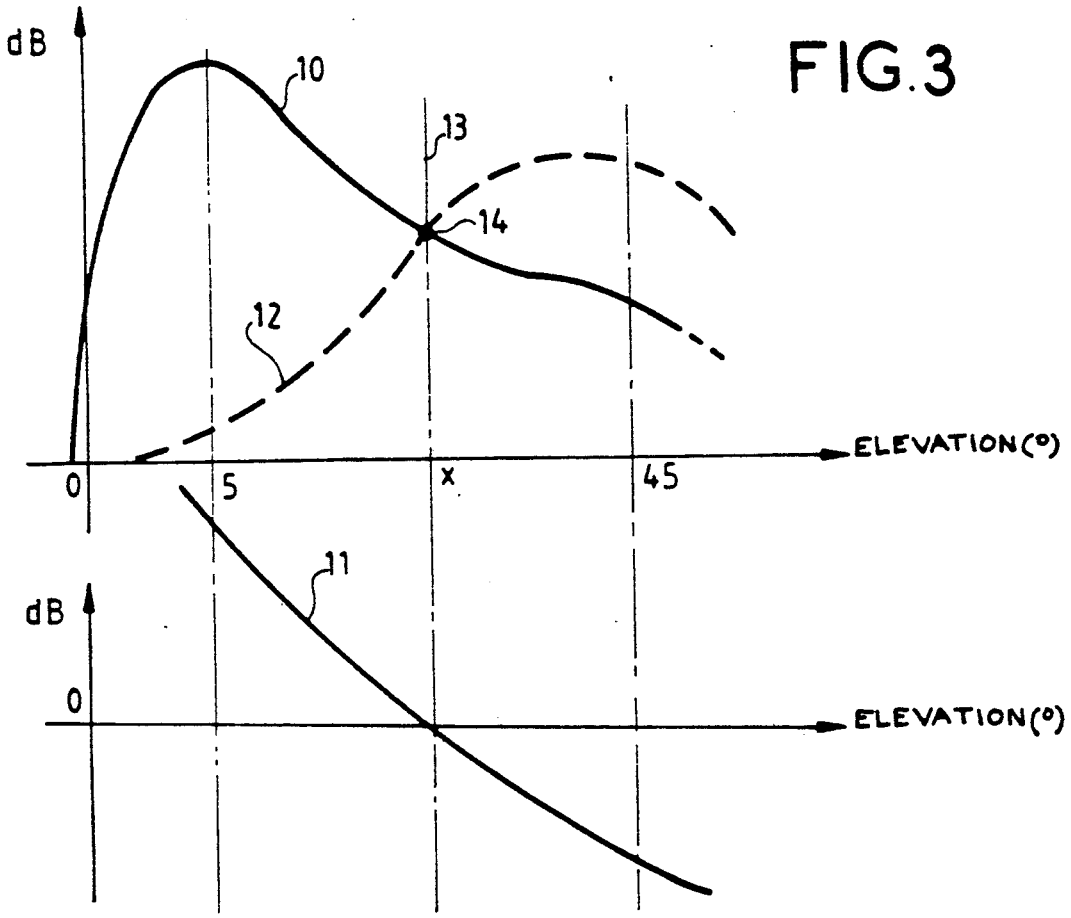
FIG.3
FIG.4
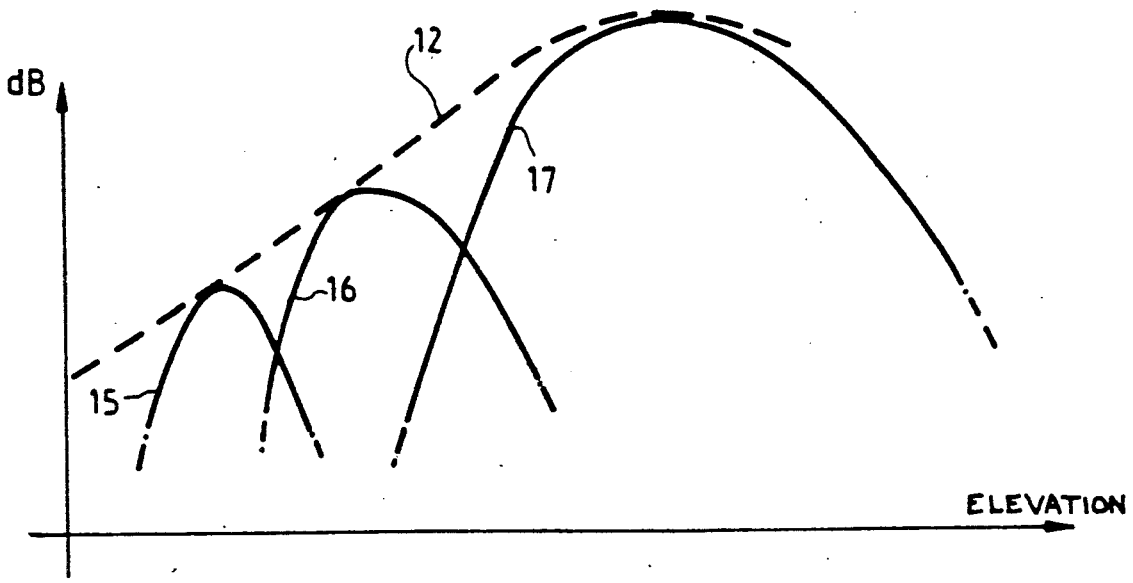

DEVICE TO MEASURE THE ELEVATION ANGLE FOR A RADAR EQUIPPED WITH A DOUBLE CURVATURE RELECTIVE TYPE ANTENNA

BACKGROUND OF THE INVENTION

The present invention relates to a device for the measurement of the elevation angle for a radar equipped with a double curvature reflective type of antenna.

Double curvature reflective type antennas enable a fairly precise measurement of the bearing angle of a target but, since their pattern of coverage in elevation is very wide (generally a cosecant-squared pattern covering between 5° and 45° in elevation approximately), they cannot be used to measure elevation angles.

At present, to carry out a measurement of elevation with a wide angular range, either multiple-beam antennas or electronic scanning antennas are used. In the former case, it is necessary to radiate a large number of beams to achieve satisfactory precision; hence it is necessary to use a large number of receivers, thus making the measurement device costly. In the latter case, a large number of electronic phase-shifters have to be used, thus increasing the complexity and the cost of the measuring device.

SUMMARY OF THE INVENTION

An object of the present invention is a device for the measurement of elevation angles of targets, using a simple and inexpensive reflective antenna of the above-mentioned type.

The measurement device according to the present invention is applied to a radar with a double curvature reflective type of antenna, connected to a main measurement channel, wherein there is positioned, in the antenna, beneath the main primary source, an auxiliary source having at least two elementary sources connected to a distributor which is itself connected to an auxiliary measurement channel, the two measurement channels being connected to a divider.

According to an advantageous characteristic of the invention, the auxiliary source has, in the elevation plane, a radiation pattern having substantially the same shape as that of the main source in the same plane, with respect to a vertical straight line, passing substantially through the middle of the range of elevation angles in which measurements are to be made.

BRIEF DESCRIPTION OF THE DRAWINGS

The present invention shall be understood more clearly from the following detailed description of an embodiment, taken as a non-restrictive example and illustrated by the appended drawings, of which:

FIG. 3 is a set of curves explaining the working of the measurement device according to the invention;

FIG. 4 is a graph showing the way to combine the radiation patterns of the elementary antennas of the device according to the invention.

DETAILED DESCRIPTION OF THE INVENTION

Figure 1:
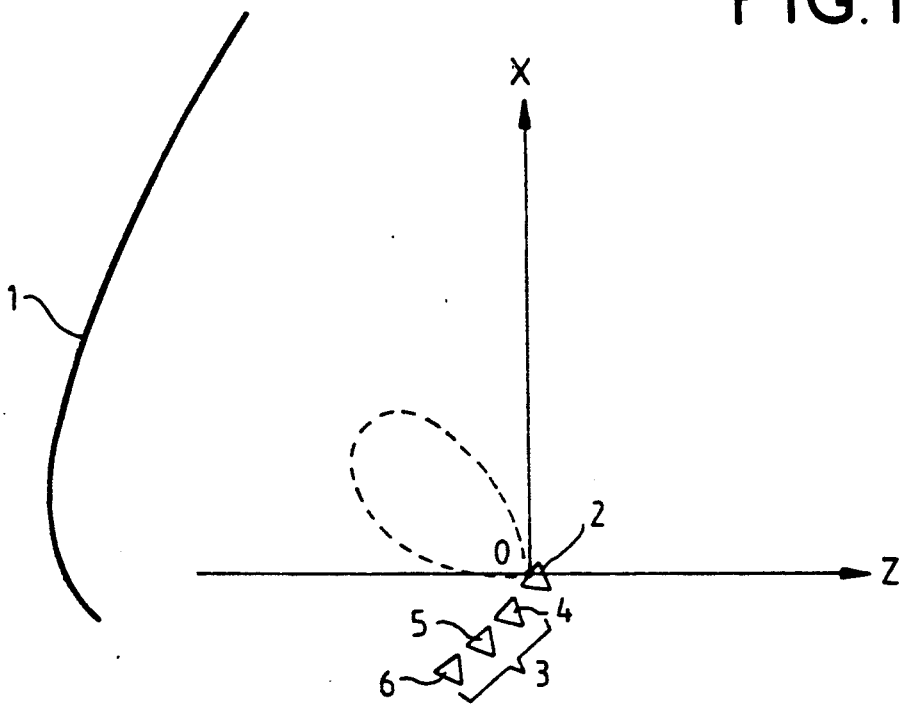
FIG. 1 shows a partial and simplified view of an antenna of a measurement device according to the invention.

The measuring device of the present invention uses a radar with a reflective antenna. This antenna is the well-known double curvature reflective type. It shall merely be recalled, herein, that the reflector of such an antenna is generated by a group of parabolas lying along a curve called a "central curve". This curve is located in the vertical plane of symmetry XOZ of the antenna. In FIG. 1, this plane is that of the drawing. For the clarity of the drawing, only the central curve 1 is shown in FIG. 1.

A primary source 2 which may be, for example, of the horn type, illuminates, in emission, the reflector lying along the central curve 1. The phase center 0 of the source 2 is located at the focal point of the plane XOZ. The shape of the central curve 1 makes it possible, given the shape of the primary pattern of the source 2, to obtain the desired elevation coverage pattern, for example a cosecant-squared pattern.

The measurement of the azimuth angle of the targets identified by the antenna is done in a usual way with generally sufficient precision owing to the fact that the generating parabolas of the reflector, which are not modified, have good azimuthal directivity.

According to the invention, a primary auxiliary source 3 is added to the primary source 2, hereinafter called the main source. In the example shown, the source 3 has three elementary sources 4, 5 and 6, but it is clear that the number of these elementary sources may be different, and may vary between 2 and 5 approximately. This source 3 is positioned beneath the source 2, in the plane of symmetry XOZ. Advantageously, the three elementary sources 4 to 6 are identical to the source 2, in order to reduce the cost of the assembly. The maximum number of elementary sources constituting the source 3 is, in particular, determined by the space available beneath the source 2, and it is determined in such a way that the elementary sources can "see" the reflector of the source 2.

Figure 2:
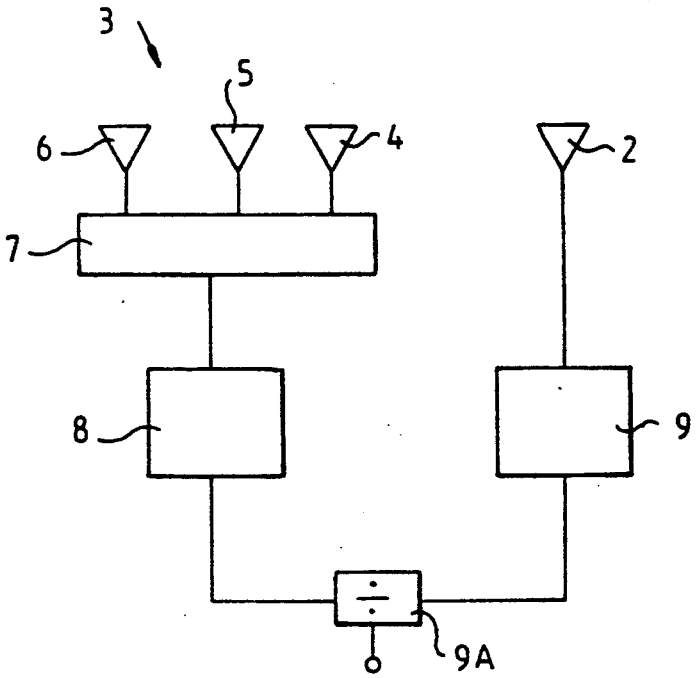
FIG. 2 shows a simplified electrical diagram of a connection of elementary antennas of the device of the invention.

As shown in FIG. 2, the elementary sources 4 to 6 are supplied by an amplitude and/or phase distributor 7 connected to the auxiliary measurement channel 8. This auxiliary channel 8 is similar to the main measurement channel 9 supplying the source 2. Since both these radar measurement channels are well known per se, they shall not be described in greater detail. These two channels are connected to a divider 9A, at the output of which the desired elevation angle is collected. Herein, referring to FIGS. 3 and 4, we shall describe only the patterns of radiation that ought to be produced by the sources 2 and 3, and the manner in which the signals from these sources are combined.

The graphs of FIGS. 3 and 4 have logarithmic y-axis values, expressed in decibels. Their x-axis values are linear and are expressed in elevation angle values.

At the upper part of FIG. 3, the curve 10, drawn in a solid line, is that of the radiation pattern of the source 2. At the lower part of FIG. 3, a solid line represents an exemplary curve 11 that ought to be produced by the source 3. This curve 11 is substantially linear, and enables elevation angles to be measured with high precision over a wide range of values of elevation angles. This curve 11, while it is not truly linear, should at least be monotonous (without extremum) and it has, preferably, a steep slope (variation of at least about 20 dB for a variation in the elevation angle of 5° to 45° approximately).

To obtain a curve 11, as shown in FIG. 3, from the curve 10, it is necessary to carry out the subtraction (the subtraction of graphs with y-axis values expressed in decibels is equivalent to a division of signals), from the curve 10, of a curve such as the curve 12 shown in broken lines at the top of FIG. 3. This curve 12 is more or less symmetrical with the curve 10 in relation to a vertical straight line 13 passing through a point 14 of this curve 10. The x-axis coordinate of this point 14 is substantially in the middle of the range of elevation angles in which it is sought to make measurements. In the present case, this range goes from 5° to 45° approximately. The subtraction is done simply by means of the divider 9A connected to the outputs of the measurement channels 9 and 8, in a manner that is clear to those skilled in the art.

As a rule, the radiation pattern of the main source 2 (curve 10) is combined with a pattern that can be produced by the source 3 in order to obtain a monotonous curve in the desired range of elevation angles, this monotonous curve having a slope sufficient to obtain the desired measuring precision (of the order of 1°).

FIG. 4 shows the manner of obtaining the curve 12 by means of the composition of the patterns of several elementary sources. In the present case, as specified here above, three elementary sources (4 to 6) are used.

Since these elementary sources are positioned side by side beneath the source 2, hence outside the focal point O of the reflector, their respective radiation patterns 15, 16, 17 are different from the pattern 10 of the source 2. Each of these patterns 15 to 17 has a roughly parabolic shape, and their tops are offset with respect to one another on the x-axis and on the y-axis, and are located on the curve 12 or in its immediate vicinity. Thus, the aperture of the parabolas 15 to 17 is all the greater as the corresponding sources are at a distance from the focal point 0. The first parabola 15 is the smallest one, and the ones that follow are increasingly bigger. The point-by-point addition of the y-axis values of parabolas gives the desired curve 12. The desired combination of the radiation patterns of the elementary sources is achieved simply by the adjustment of the distributor 7 in a manner clear to those skilled in the art.

It will be noted that the geometry of each elementary source has little effect on the pattern 12. The shape of this pattern depends essentially on the shape of the central curve 1 (defined beforehand as a function of the elevation coverage pattern specified for the radar) and on the position of the phase center of each elementary source in the plane XOZ.

The defocusing of the elementary sources results in an enlargement of their corresponding secondary patterns in azimuth, i.e. in planes perpendicular to the plane XOZ. However, this phenomenon is not bothersome because the method used to measure the elevation angle is implemented only when the target has been detected on the main channel in a given azimuth.

To make the auxiliary source 3, the following procedure is preferably used. First of all, the number N of elementary sources constituting it is chosen. This number is a function of the range of elevation angles considered and, as specified here above, it is limited by the amount of space available. Since, the geometry of each elementary source has little effect on the pattern of the auxiliary source, it is fixed and preferably is the same as that of the main source. Four parameters can be made to vary for each of the elementary sources: two for its position in the plane XOZ (xi, zi), and two relating to its electrical supply (phase and amplitude with respect to those of the main source) so as to obtain the desired curve 12, and more generally speaking, so as to obtain a monotonous characteristic curve 11. Preferably, an optimization software program, the programming of which will be obvious to those skilled in the art from a reading of the present invention, will be used to determine the set of 4N parameters (four parameters for each of the N elementary sources) enabling the desired pattern 12 to be approached as closely as possible by the least mean squares method.

What is claimed is:

1. An elevation angle measurement device for a radar, comprising:

a double curvature reflective type antenna;

a primary source positioned in the antenna;

a main measurement channel connected to said primary source;

an auxiliary source positioned beneath the primary source, the auxiliary source comprising at least two elementary sources;

a distributor connected to said at least two elementary sources;

an auxiliary measurement channel connected to said distributor;

a divider connected to said main measurement channel and said auxiliary measurement channel.

2. The device according to claim 1, wherein a supply of the auxiliary sources in amplitude and/or in phase, and their position in an elevation plane (XOZ) are adjusted in such a way that a characteristic obtained by division of signals detected by the measurement channels of the main source and of the auxiliary source has a monotonous shape in a desired range of elevation angles.

3. A device according to claim 2, wherein said characteristic has a variation of at least about 20 dB for a variation, in elevation angle, of 5° to 45°.

4. A device according to claim 1, wherein the auxiliary source has, in an elevation plane, a radiation pattern, a shape of which is substantially symmetrical with that of the main source in the elevation plane, with respect to a vertical straight line, passing substantially through a middle of a range of elevation angles in which measurements are to be made.

* * * * *

UNITED STATES PATENT AND TRADEMARK OFFICE

CERTIFICATE OF CORRECTION

PATENT NO. : 5,138,324

DATED : August 11, 1992

INVENTOR(S) : Claude Aubry et al.

It is certified that error appears in the above-identified patent and that said Letters Patent is hereby corrected as shown below:

Title page, item [54], and col. 1, lines 1-3, should read --DEVICE TO MEASURE THE ELEVATION ANGLE FOR A RADAR EQUIPPED WITH A DOUBLE CURVATURE REFLECTIVE TYPE ANTENNA--.

Signed and Sealed this

Twenty-fourth Day of August, 1993

Bruce Lehman

*Attest:*

BRUCE LEHMAN

*Attesting Officer*

*Commissioner of Patents and Trademarks*